US007543623B2

(12) United States Patent
Allardyce et al.

(10) Patent No.: US 7,543,623 B2
(45) Date of Patent: Jun. 9, 2009

(54) INSULATED GLASS WINDOW SHADE

(75) Inventors: James D. Allardyce, Grandville, MI (US); Michael S. Eveland, Fennville, MI (US); Andrew R. Krochmal, Grand Haven, MI (US); Joshua R. Cornish, Holland, MI (US)

(73) Assignee: ODL, Incorporated, Zeeland, MI (US)

( * ) Notice: Subject to any disclaimer, the term of this patent is extended or adjusted under 35 U.S.C. 154(b) by 418 days.

(21) Appl. No.: 11/292,719

(22) Filed: Dec. 2, 2005

(65) Prior Publication Data

US 2007/0125504 A1 Jun. 7, 2007

(51) Int. Cl.
*E06B 3/32* (2006.01)

(52) U.S. Cl. ..... 160/107; 160/169; 160/172 R

(58) Field of Classification Search ..... 160/107, 160/172 R, 84.06, 167 R, 169
See application file for complete search history.

(56) References Cited

U.S. PATENT DOCUMENTS 2,013,500 A * 9/1935 O'Connor ..... 248/269
2,389,956 A 11/1945 Castilonia et al.
2,434,786 A * 1/1948 Browning ..... 160/34
2,492,867 A * 12/1949 Johnson ..... 160/167 R
3,342,243 A * 9/1967 Salter ..... 160/107
5,462,105 A * 10/1995 Supernak ..... 160/323.1
5,826,638 A * 10/1998 Jelic ..... 160/107
5,996,668 A 12/1999 DeBlock et al.
6,601,633 B2 * 8/2003 Sun et al. ..... 160/107
6,817,401 B2 11/2004 Sun et al.
6,932,139 B2 * 8/2005 Early et al. ..... 160/107
2003/0173036 A1 9/2003 Kwon et al.
2004/0238131 A1 12/2004 Eveland et al.
2007/0068635 A1 * 3/2007 Nicolosi ..... 160/98

FOREIGN PATENT DOCUMENTS

WO WO 90/15914 12/1990

* cited by examiner

*Primary Examiner*—Blair M. Johnson
(74) *Attorney, Agent, or Firm*—Warner Norcross & Judd LLP

(57) ABSTRACT

An insulated glass window assembly including a cordless integral shade with level correction, a sliding follower, and an air permeable spacer assembly. Cords are eliminated by confining the window covering movement to one dimension. Level correction is achieved by pivotally connecting the shade bar to the supporting operator or shade support, so that the bar can be re-leveled by raising or lowering the bar against the IG spacer. The follower slides in a track on one side of the IG. The spacer includes an air passageway between the desiccant chamber and the space between IG space, and the hole is covered by an air-permeable patch to prevent unwanted leakage of desiccant into the viewable area.

9 Claims, 7 Drawing Sheets

INSULATED GLASS WINDOW SHADE

BACKGROUND OF THE INVENTION

The present invention relates generally to window shades, and more particularly to window shades for insulated glass.

Insulated glass window assemblies with internal shades are well known. The insulated glass includes two glass panels separated by a spacer to define a space between the panels. The internal shade is positioned within the space and is operated by actuators that are outside of the insulated glass but magnetically coupled to the shade.

Some insulated glass window assemblies have integral shades which can suffer from pleat "blow-out," which is a condition where the shade pleats no longer accordion fold together. One approach to preventing blow-out is to thread cords through the shade pleats to ensure that they always accordion fold together. Unfortunately, these cords are in the viewing area of the glass, and both the cords and the associated pleat holes detract from the aesthetics of the shade.

The IG shades often include a bar at the top and/or bottom of the shade to which the shade material is attached. Ideally, the bars remain level within the window, even after repeated operation. In reality, the bars often move out of level over time. Re-leveling the bars is difficult to impossible given the inaccessibility of the shade.

SUMMARY OF THE INVENTION

The aforementioned problems are overcome by the present invention wherein a pivoted shade operator or shade stabilizer bar provides level correction; a sliding interface supports the shade operator or shade assembly within the insulated glass; and an IG spacer assembly includes a hole covered by an air-permeable patch to permit airflow between the IG space and desiccant within the spacer assembly.

In a first aspect of the invention the IG construction includes a pair of channels at opposite sides of the IG opening toward one another. The ends of the shade material ride within the channels to ensure that the shade moves properly without blowout. This aspect of the invention eliminates the need for cords threaded through the shade.

In a second aspect of the invention, the shade assembly includes a level correction feature. A bar of the shade assembly pivotally attaches to the shade support. When the shade assembly is fully raised or fully lowered, the bar pivots on the shade support as the bar engages the top or bottom of the IG to return the bar to a level orientation. Preferably, a damper (for example some form of frictional resistance) is included between the bar and the shade support to reduce relative movement of the two pieces following level correction.

In a third aspect of the invention, the follower slides within a track at the side of the IG. Preferably, the follower is fabricated of a lubricious resin to provide an appropriate slip-stick interface between the two components 1) enabling the follower to move in response to the operator and 2) retaining the follower in a fixed vertical position when the pressure is removed. Further preferably, offset protrusions on the follower are used to further control surface contact between the followers and the track. Optionally, a lubricant may be used to improve the smoothness of operation.

In a fourth aspect of the invention, the IG spacer assembly contains desiccant and defines at least one hole covered by an air permeable patch 1) enabling air to circulate between the IG space and the desiccant and 2) preventing desiccant from falling out of the spacer and into the viewable area.

These and other objects, advantages, and features of the invention will be readily understood and appreciated by reference to the description of the current embodiment and the drawings.

DESCRIPTION OF THE CURRENT EMBODIMENT

The elements illustrated in the Figures interoperate as explained in more detail below. Before setting forth the detailed explanation, however, it is noted that all of the discussion below, regardless of the particular implementation being described, is exemplary in nature, rather than limiting.

Figure 1:
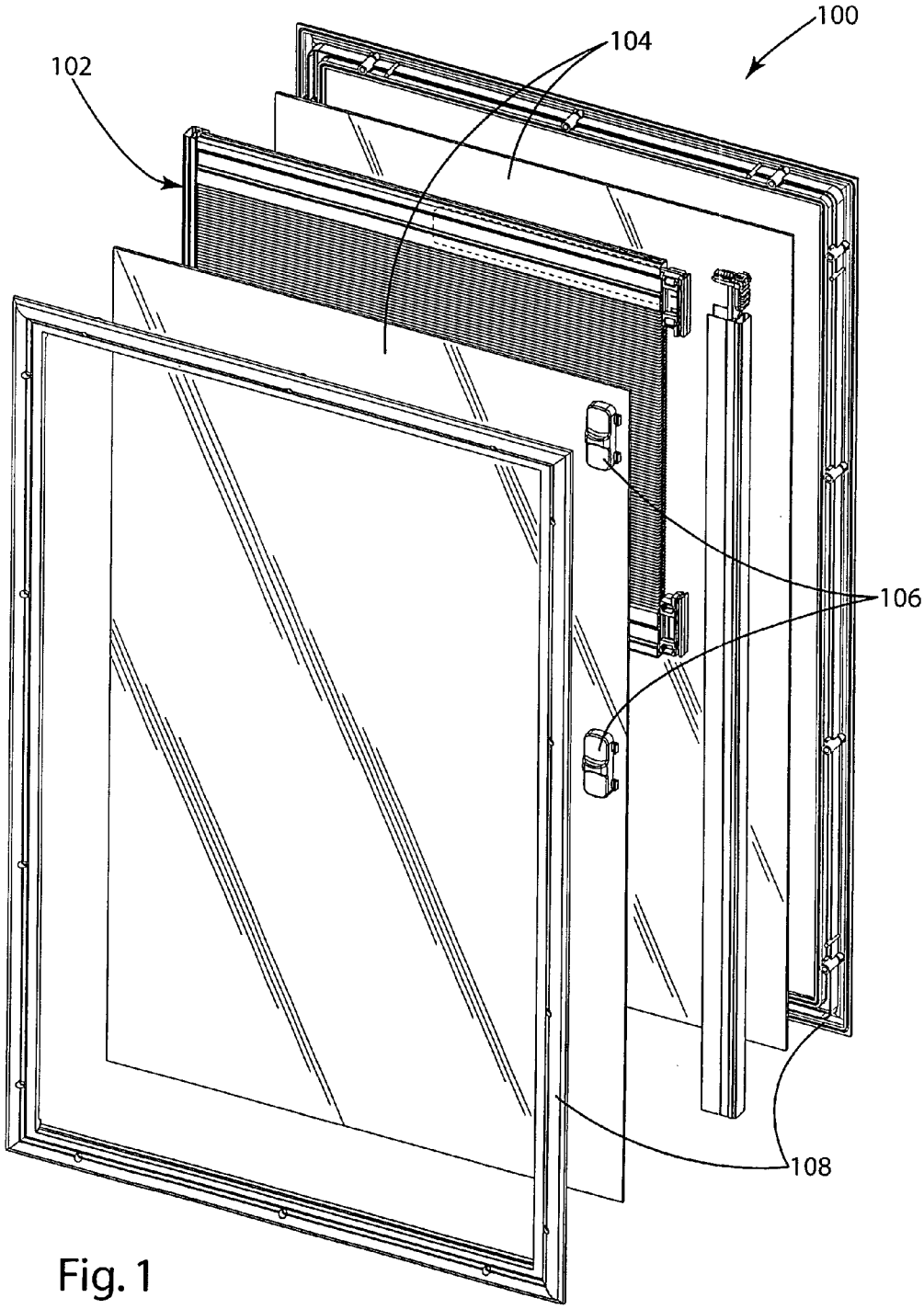
FIG. 1 is a perspective view of an integral shade in accordance with one embodiment of the present invention.

An integral shade 100 according to one embodiment of the present invention is shown in FIG. 1. The integral shade 100 is a cordless shade with level correction, a sliding follower, and a spacer assembly. The integral shade 100 may be installed in any suitable visual or physical egress, such as a window or door (not shown).

The integral shade 100 shown in FIG. 1 may include a shade assembly 102, insulated glass 104 sandwiching the shade assembly 102, one or more operators 106 coupled to the shade assembly 102 through the glass, and a frame assembly 108 sandwiching the glass 104. In one embodiment, the frame is fixed within a structure while the shade assembly is movable within the frame.

Figure 2:
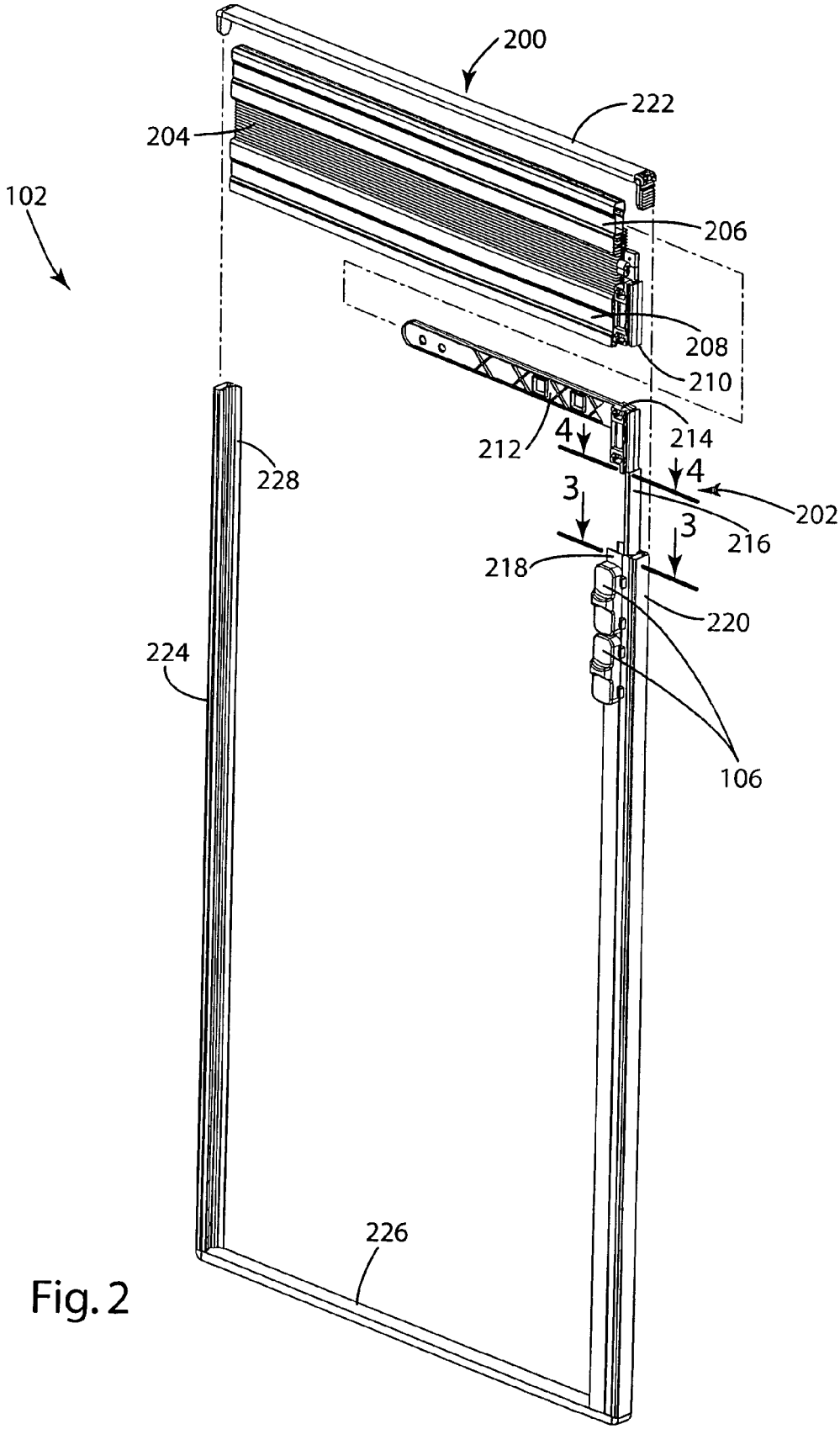
FIG. 2 is a perspective view of the shade assembly in accordance with one embodiment of the present invention.

FIG. 2 is a perspective view of the shade assembly 102. The shade assembly 102 may include a shade portion 200 and a support portion 202. The operators 106 may be operated to adjust the shade portion 200 of the shade assembly 102 through the glass 104 (not shown in FIG. 2) using magnetic forces.

The shade portion 200 may include a window covering 204, a bar or stabilizer cover 206, 208. In one embodiment, the shade portion 200 includes two stabilizer covers, a top stabilizer cover 206, and a bottom stabilizer cover 208. The top of the window covering 204 is attached to the top stabilizer cover 206 and the bottom of the window covering 204 is attached to the bottom stabilizer cover 208. In another embodiment, the shade portion 200 only includes one stabilizer cover. The window covering 204 may be a pleated shade with any suitable level of opacity, including clear. Although a pleated shade 204 is depicted, a wide variety of window coverings may be substituted. For example, the pleated shade 204 could be a slatted blind, a fabric, or cellular shade.

The support portion 202 of the shade assembly 102 may include an upper and/or lower shade support arm 212, a top and/or bottom follower 214, 210, one or more follower tracks 216, one or more cover caps 218, 228, and a spacer assembly 220, 222, 224, 226. In one embodiment the spacer assembly includes two vertical spacers 220, 224 and two horizontal spacers 222, 226 that frame the shade assembly and provide structure to the IG shade. The shade support 202 may inter-fit with the shade portion 200. Specifically, in one embodiment, the upper shade support arm 212 fits inside and connects to the top stabilizer cover 206 and the lower shade support arm 212 fits inside and connects with the bottom stabilizer cover 208. In one embodiment, a right cover cap 218 forms one channel and a left cover cap 228 forms another channel at an opposite side of the IG, the channels open toward one another for the ends of the window covering 204 to ride in.

The shade portion 200 of the shade assembly 102 can be raised and lowered by moving the top and/or bottom magnetic operators 106 up or down. The magnetic coupling between the magnetic operator 106 and the follower 214 is sufficient such that the follower 214 follows the magnetic operator 106 when moved. Similarly, the lower portion of the shade assembly 102 can be raised and lowered by moving the bottom magnetic operator 106 coupled to the bottom follower 210. In another embodiment, the shade assembly 102 is configured for side to side operation. In an alternative embodiment, with only one stabilizer cover, one end of the shade assembly 102 is fixed while the other end may be adjusted.

I. Cordless

Figure 3A:
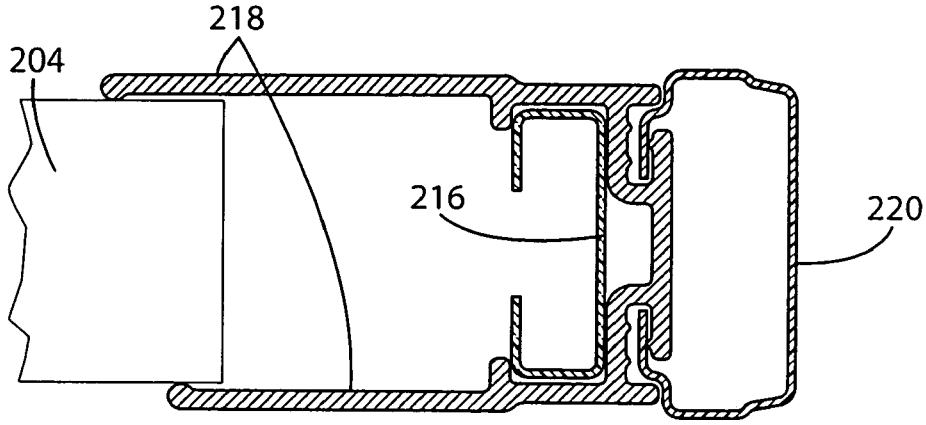
FIG. 3A is a top sectional view of a portion of the shade assembly in accordance with one embodiment of the present invention.

FIG. 3A is a top sectional view of a portion of the shade assembly. The shade assembly 102 may be configured such that cords are unnecessary to prevent pleat blow-out. Pleat blow-out may occur when the window covering 204 has excessive multi-dimensional freedom of movement. Accordingly, in one embodiment of the present invention, the channels formed by the cover caps 218, 228 may restrain freedom of movement of the window covering 204 to substantially one dimension thereby reducing pleat blow-out. In another embodiment of the present invention, the channels merely reduce the dimensional freedom of movement of the window covering 204. Varying amounts of restraint may be achieved by varying the amount of cover cap overhang on the window covering 204 to create a desired fit between the cover caps 218, 228 and the window covering 204. In one embodiment, the fit is snug such that pleat blow-out is substantially reduced.

Figure 3B:
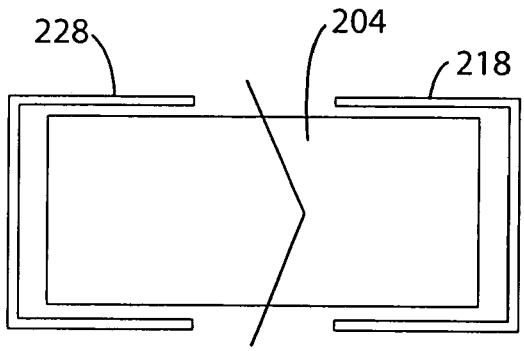
FIG. 3B is a top sectional view of a portion of an alternative shade assembly in accordance with one embodiment of the present invention.

The cover caps 218, 228 may restrain movement on one or both ends and one or both sides of the window covering 204. In one exemplary embodiment, depicted in FIG. 3B, both window covering ends and both window covering sides are restrained by the cover caps 218, 228 in a symmetrical fashion.

Figure 3C:
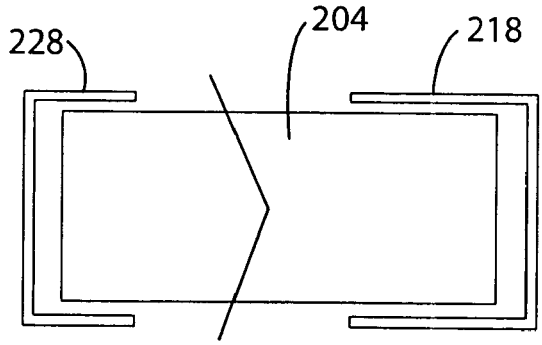
FIG. 3C is a top sectional view of a portion of an alternative shade assembly in accordance with one embodiment of the present invention.

The amount of restraint may vary. In one embodiment the cover caps 218, 228 hang over the window covering 204 to restrain dimensional movement a minimally sufficient amount thereby maximizing viewable area. In an alternative embodiment, aesthetic concerns govern the amount of restraint. For example, in one embodiment, depicted in FIG. 3C, the right cover cap 218 hides the followers and therefore overhangs the window covering 204 more than the left cover cap 228 where there is no follower to hide. In one embodiment the right cover 218 is a dust cover which hides any inaccessible dust which may form on the inside glass where the follower slides.

II. Sliding Follower

Figure 4:
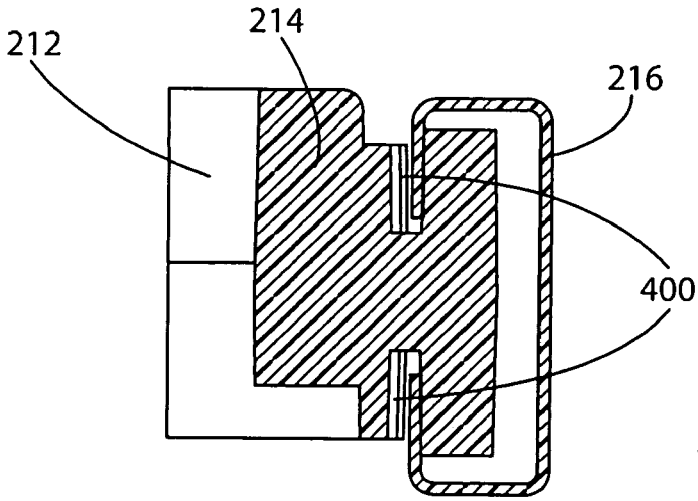
FIG. 4 is a top sectional view of the shade support arm, follower, and follower track in accordance with one embodiment of the present invention.

FIGS. 2-4 depict how the followers 210, 214 interface the follower track 216. FIG. 4 is a top sectional view of the shade support 212, the top follower 214, and follower track 216. The top and bottom followers 210, 214 may simultaneously fit in follower track 216. The followers 210, 214 interface the follower track 216 by fitting in one or more follower interface channels 400. In one embodiment, one or more additional followers may exist at different locations of the shade assembly and interface an additional appropriately placed follower track. In a further extension of that embodiment, additional operators which couple to the additional followers may replace or augment the ones already in place.

The followers 210, 214 may be made of any suitable material. In one embodiment the followers 210, 214 are relatively lightweight and plastic. In another embodiment the followers 210, 214 are made from a plastic alternative that adequately cooperates with an aluminum follower track 216.

The follower track 216 may also be made of any suitable material. In one embodiment the follower track 216 is made of metal. For example, in one embodiment the follower track 216 is made from roll formed aluminum. In another embodiment the follower track 216 is made of a metal or aluminum alternative that adequately cooperates with the plastic followers 210, 214. In an alternative embodiment, the follower track 216 may be made of any metal which can be roll formed.

In one embodiment, a resin facilitates a direct slip-stick fit between the follower interface channel 400 and the follower track 216. In another embodiment, a substantially lubricious resin allows for an adequate interface. In yet another embodiment, Acetyl is an adequate resin. In one embodiment, a lubricant may be used to improve the smoothness of operation. For example, any suitable grease or silicone compound may be used. In one embodiment a low evaporation rate grease or silicone compound is desired because off-gassing may create an undesirable film on the inside of the glass over time.

In one embodiment, the followers 210, 214 interface the follower track 216 in two separate follower interface channels 400. The amount of surface contact between the followers 210, 214 and the track 216 may vary. In one embodiment, the followers 210, 214 may have a maximum amount of surface contact with the follower track 216 allowing a slip-stick fit. In another embodiment, the minimum amount of surface contact is provided.

Figure 5A:
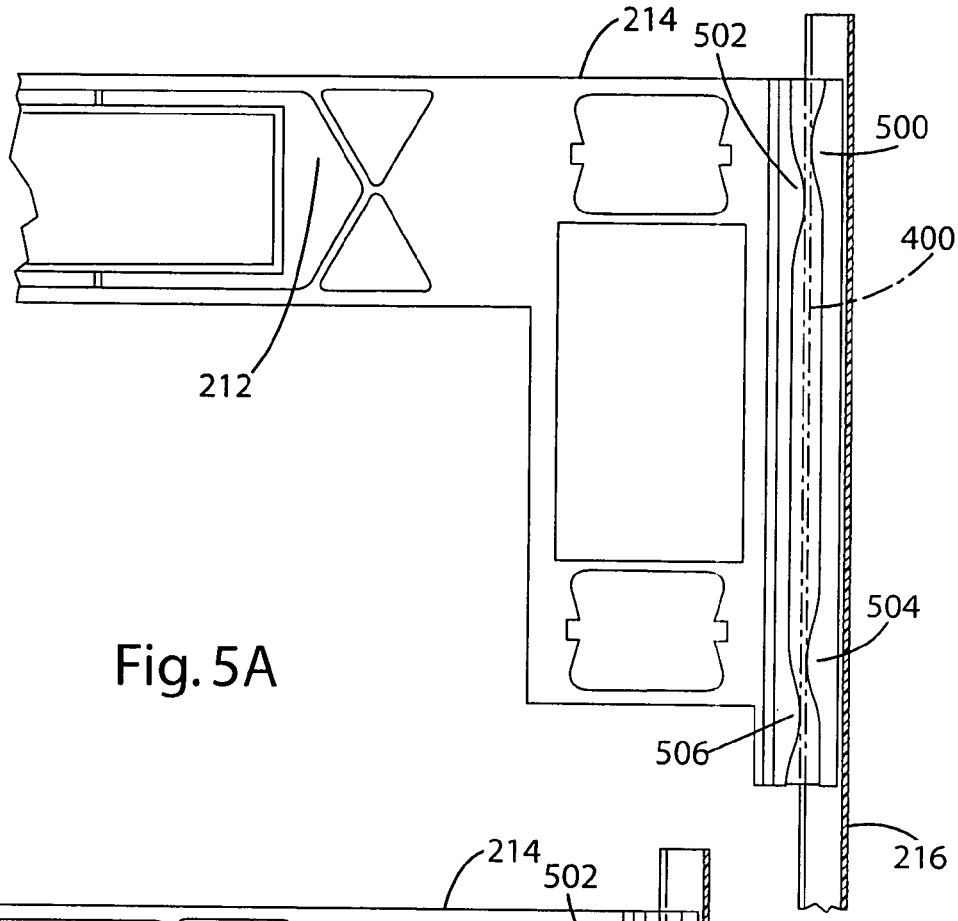
FIG. 5A depicts a side sectional view of a follower interface channel in accordance with one embodiment of the present invention.
Figure 5B:
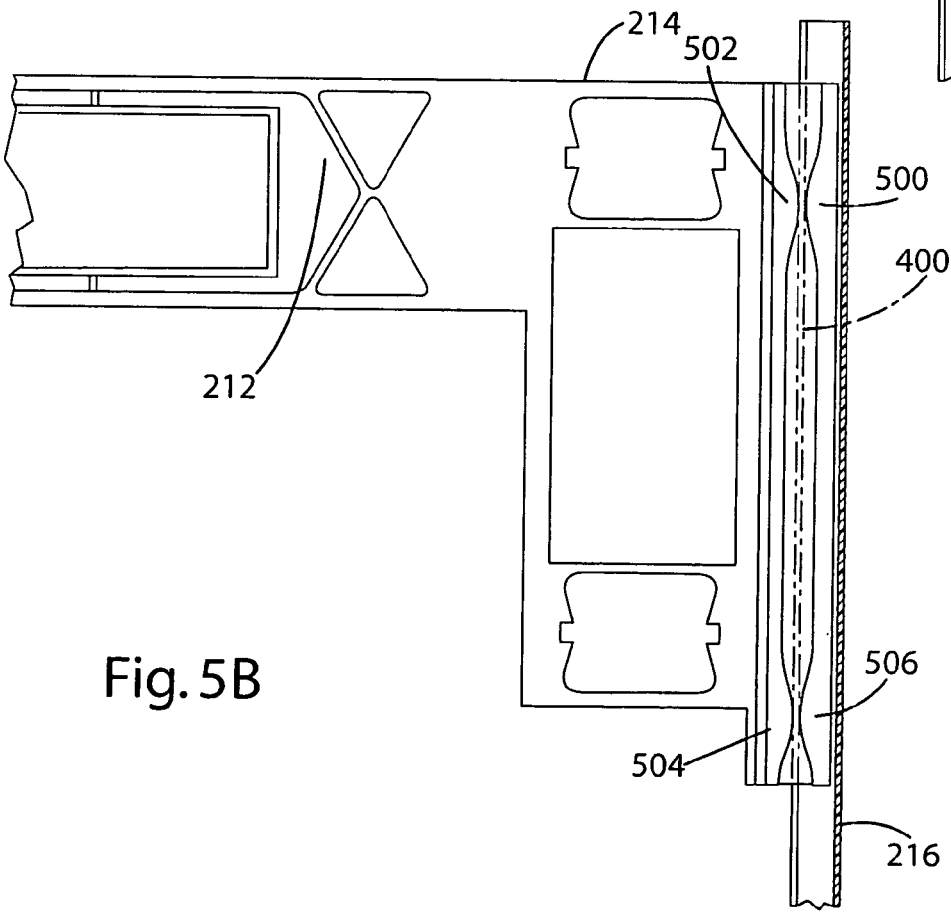
FIG. 5B depicts a side sectional view of an alternative follower interface channel in accordance with one embodiment of the present invention.

FIG. 5A depicts a side sectional view of a follower interface channel 400 in one embodiment. Four protrusions 500, 502, 504, 506 are depicted which facilitate surface contact. Offset protrusions may ease tooling. In an alternative embodiment, as shown in FIG. 5B, the protrusions 500, 502, 504, 506 are not offset and surface contact occurs at the same point on both sides of the follower interface channel 400.

III. Level Correction

Figure 6A:
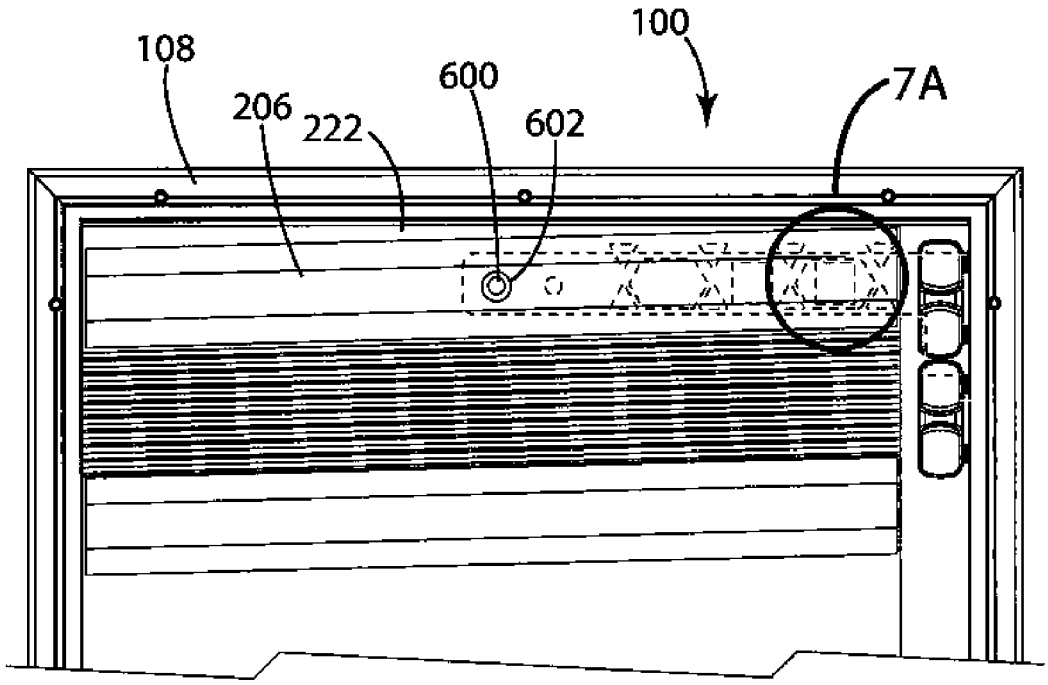
FIG. 6A is a front view of an integral shade in need of level correction in accordance with one embodiment of the present invention.
Figure 6B:
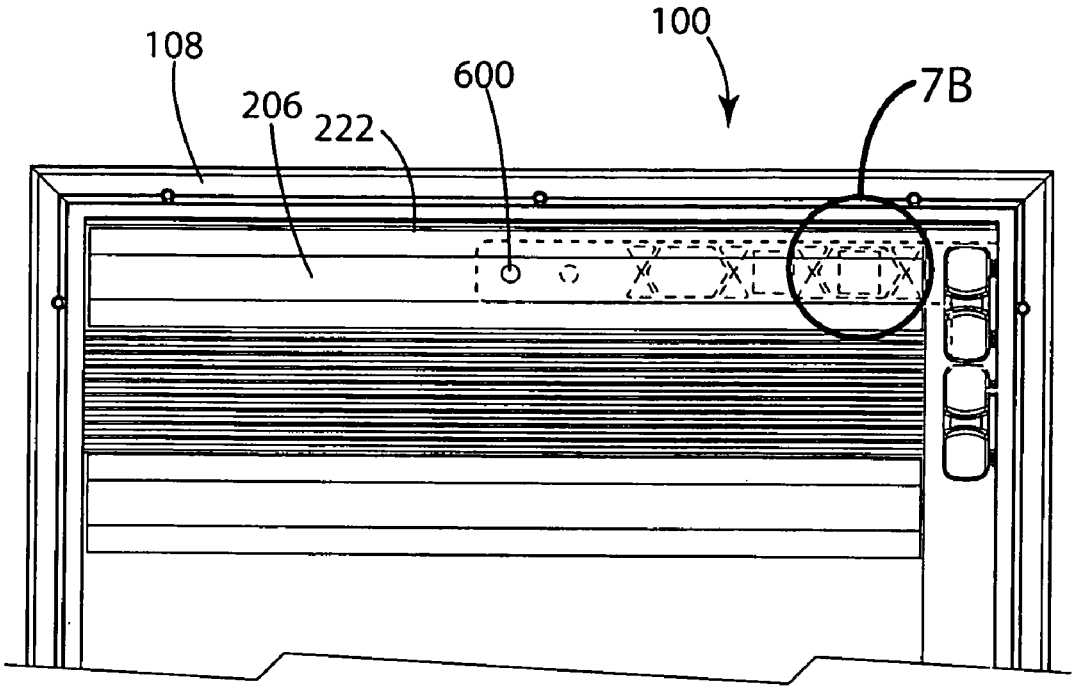
FIG. 6B is a front view of a level corrected integral shade in accordance with one embodiment of the present invention.

FIG. 6A is a front view of an integral shade 100 in need of level correction. Angle deviation between the top stabilizer cover 206 and the frame 108 or between the top stabilizer cover 206 and the horizontal spacers 222, 226 is undesirable. A pivotal connection 600 between the top stabilizer cover 206 and the shade support arm 212 allows elimination of angle deviation for at least a period of time. Resetting the shade assembly to a top position, as depicted in FIG. 6B causes the top stabilizer cover 206, along with the rest of the shade portion 200 of the shade assembly 102, to pivot and become level. In one embodiment, resetting the shade assembly causes the high portion of the top stabilizer cover 206 to contact the top horizontal spacer 222 and pivot around the pivotal connection 600 until either the top stabilizer cover 206 is level or the previously low portion of the top stabilizer cover 206 over-pivots and becomes the high end. If the top stabilizer cover 206 is not level, leveling may be manually or automatically continued by the new high portion of the top stabilizer cover 206 contacting the top horizontal spacer 222. In a more specific embodiment, the top stabilizer cover 206 is level where it is horizontal. In another embodiment, the top stabilizer cover 206 is level where it is parallel to the window frame 108 or top horizontal spacer 222. In another embodiment, the shade assembly may be altered or augmented such that the shade may be leveled in a similar fashion against the bottom portion of the frame. While the pivotal connection 600 allows level correction, a damper may be necessary to prevent shade assembly wobble as the shade assembly is operated.

Figure 7A:
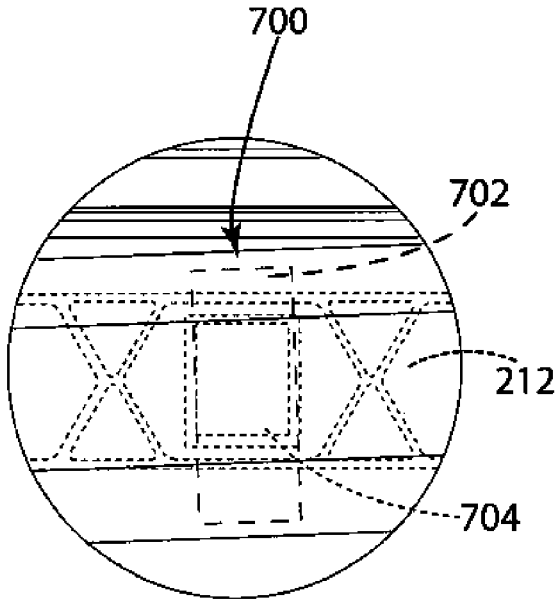
FIG. 7A is an exploded front view of a damper during angle deviation in accordance with one embodiment of the present invention.
Figure 7B:
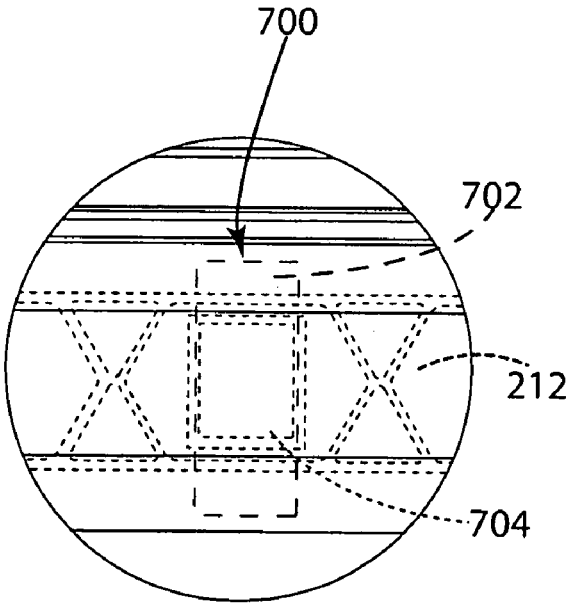
FIG. 7B is an exploded front view of a damper after level correction in accordance with one embodiment of the present invention.

FIG. 7A is an exploded front view of one example of a damper 700 during angle deviation. A damper 700 may reduce wobble between shade portion 200 and the shade support 202 or the shade support arm 212 by introducing friction or any other form of restraint. In one embodiment, the damper includes a magnet 704 on the shade support arm 212 and a magnetic strip 702 on the top stabilizer cover 206 of the shade assembly 102. The magnet 704 and magnetic strip 702 interoperate to reduce or eliminate the wobble in the shade assembly during operation. In one embodiment, the magnet 704 and magnetic strip 702 are coupled together to reduce the amount of undesired pivot as a result of the pivotal connection 600. FIG. 7B is an exploded front view of a damper 700 after level correction. The magnetic strip 702 is large enough so that during angle deviation and after level correction the magnet 704 may maintain adequate coupling to the magnetic strip 702. In another embodiment, the damper may include multiple magnets and corresponding magnetic strips. In an alternative embodiment, the damper is a rubber gasket 602 at the pivot point. The rubber gasket 602 also reduces the wobble in the shade assembly during operation. In one embodiment, the damper has consistent performance independent of temperature, dimensional variation, and molding parameters. In yet another embodiment, the damper includes detents and mating recesses on the top stabilizer cover 206 and shade support arm 212 respectively which cooperate to dampen during level correction. Alternatively, the detents are on the shade support arm 212 and the mating recesses are on the top stabilizer cover 206.

IV. Desiccant Control

Figure 8:
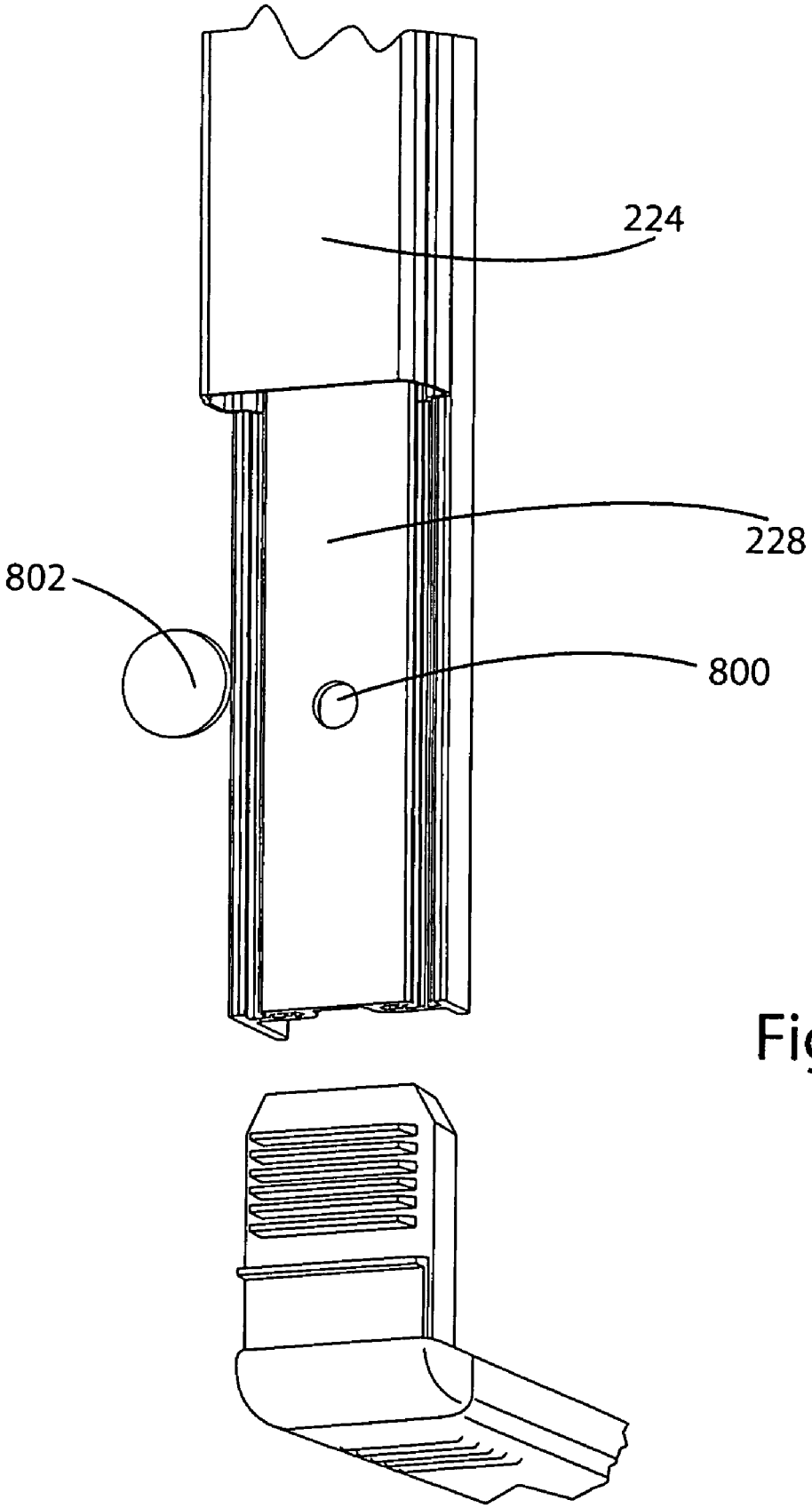
FIG. 8 is an exploded perspective view of the desiccant filled spacer assembly in accordance with one embodiment of the present invention.

FIG. 8 is an exploded perspective view of the desiccant-containing IG spacer 224. The cover caps 218, 228 form one or more vertical channels which the spacers 220, 224 can interface adequately. In one embodiment, the vertical spacer 224 is made of roll formed aluminum into a "C" shape which fits within two channels of the cover 228.

The vertical spacer 224 may be filled with desiccant or other drying agent to absorb moisture within the integral shade 100. For example, a substance, such as calcium oxide or silica gel, that has a high affinity for water and is used. In one embodiment, an air pathway between the desiccant and any target moisture is required. Accordingly, an aperture 800 is provided which creates an air pathway between the spacer 224 and the cover 228, and thereby the rest of the integral shade 100. In one embodiment, the aperture 800 is located on the cover cap 228. Further, an air-permeable patch 802 covers the aperture 800 to prevent unwanted leakage of desiccant while maintaining an air path-way between the spacer 224 and the rest of the integral shade 100. In an alternative embodiment, other spacers of the spacer assembly configured similarly may replace or augment the vertical spacer 224.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A window comprising:

an insulated glass assembly having an upper portion and a pair of glazing panels defining a space therebetween;

a shade within said space and having an upper portion;

a substantially horizontal bar within said space and attached to said upper portion of said shade; and a shade support vertically movable within said space and pivotally connected to and supporting said bar allowing said bar to pivot with respect to said shade support, whereby said bar can pivot to a horizontally level orientation when said bar is raised by said shade support against said upper portion of said insulated window assembly.

2. The window of claim 1 further comprising:

a follower operatively connected to said shade support and located within said space;

a magnetic operator magnetically coupled through said assembly to said follower enabling said follower to be moved by moving said magnetic operator; and a damper between said bar and said shade support.

3. The window of claim 2 where said damper performance is independent of temperature, dimensional variation, and molding parameters.

4. The window of claim 1 further comprising a damper to reduce wobble between the bar and the shade support.

5. The window of claim 4 wherein the damper is a magnetic damper.

6. A window assembly comprising:

a shade;

a bar attached to said shade;

a shade support pivotally connected to said bar allowing said shade to be leveled parallel to said frame;

glass sandwiching said shade;

a follower operatively connected to the shade support;

a magnetic operator coupled through said glass to said follower; and a damper between said bar and said shade support, said damper comprising a magnet on one of said shade support and said bar and a steel strip on the other of said shade support and said bar, both located a distance away from said pivotal connection.

7. An insulated glass assembly comprising:

a pair of glazing panels defining a space therebetween;

a shade within the space and including an upper portion having a substantially horizontal bar;

a member fixedly supported between the pair of glazing panels;

an operating mechanism within the glass and including an arm movable in a vertical direction; and connection means for pivotally connecting the bar to the arm, whereby the bar can move about the connection means to a horizontally level orientation when the bar is raised by the arm against the member.

8. The insulated glass assembly of claim 7 further comprising a damper to reduce wobble between the bar and the arm.

9. The insulated glass assembly of claim 8 wherein the damper is a magnetic damper.

* * * * *